US005642884A

United States Patent [19]

Pitcher

[11] Patent Number: 5,642,884

[45] Date of Patent: Jul. 1, 1997

[54] HOLOGRAPHIC IMAGE RECONSTRUCTION PUZZLE

[75] Inventor: David E. Pitcher, Cambridge, Mass.

[73] Assignee: Polaroid Corporation, Cambridge, Mass.

[21] Appl. No.: 624,877

[22] Filed: Mar. 27, 1996

[51] Int. Cl.[6] ..... A63F 9/12

[52] U.S. Cl. ..... 273/157 R; 273/153 S

[58] Field of Search ..... 273/153 R, 153 S, 273/157 R, 155; 359/1, 22–24; 430/1

[56] References Cited

U.S. PATENT DOCUMENTS

| | | | |
|---|---|---|---|
| 4,175,750 | 11/1979 | Rugheimer et al. | 273/157 R |
| 4,420,218 | 12/1983 | Rubanov et al. | 359/24 |
| 4,421,311 | 12/1983 | Sebesteny | 273/153 S |
| 4,588,664 | 5/1986 | Fielding et al. | 430/1 |
| 4,605,231 | 8/1986 | Richman | 273/157 A |
| 4,696,876 | 9/1987 | Cael | 430/1 |
| 4,802,673 | 2/1989 | Patel | 273/153 S |
| 5,071,597 | 12/1991 | D'Amato et al. | 264/1.3 |
| 5,191,449 | 3/1993 | Newswanger | 359/23 |
| 5,516,336 | 5/1996 | Molee | 359/1 |

OTHER PUBLICATIONS

Jerry Slocum and Jack Botermans, *Puzzle: Old & New: How to Make and Solve Them,* (Europe bv: Plenary Publications International, 1986) (ISBN–0–295–96350–6) (selected pages).

Photocopy of a single–holographic image sliding tile puzzle (publicly shown in New York City in Jan. 1996).

Photocopy of a multi–holographic image tile puzzle (publicity shown in New York City in Jan. 1996).

Photocopy of a jigsaw puzzle bearing and embossed single–image display hologram (purchased on information and belief prior to 1995, at the MIT Museum Shop, Cambridge, MA).

*Primary Examiner*—Steven B. Wong
*Attorney, Agent, or Firm*—Renato M. de Luna

[57] ABSTRACT

A puzzle, solved by arranging scrambled visual information in a predetermined visually recognizable pattern, is provided. In one form, the puzzle comprises a plurality of puzzle pieces arrangeable to form at least one surface according to said predetermined visually recognizable pattern, at least one of said pieces bearing a reflection hologram designed to reconstruct a first form of visual image information when observed at a first viewing angle and a second form of visual image information when observed at a second viewing angle, said first and second forms of visual image information being "different in type". In another form, the present invention provides a puzzle comprising a plurality of puzzle pieces arrangeable to form at least one surface according to a predetermined visually recognizable pattern, and wherein at least one of said pieces bears a reflection hologram designed to reconstruct visual image information, the peak angle of reconstruction being substantially normal to said surface.

6 Claims, 1 Drawing Sheet

HOLOGRAPHIC IMAGE RECONSTRUCTION PUZZLE

FIELD OF THE INVENTION

The present invention is directed generally to puzzles, and particularly, to puzzles solved by arranging scrambled visual information in a predetermined pattern.

BACKGROUND

Puzzles have long been enjoyed as an engaging diversion. While frustration is oftentimes felt during attempts to solve a puzzle, its successful completion usually produces a somewhat satisfying feeling of accomplishment. However, as most are aware, this feeling is diminished when the puzzle and/or its solution are perceived to be "too simple".

Varieties of puzzles are several. Some are mechanical in nature—such as twisted nail puzzles and block puzzles. Other are linguistic in nature—such as crossword puzzles, acrostics, word searches, and the like. While certain classes of puzzles may have uncertain boundaries, among the several varieties of puzzles, one grouping can be clearly identified by the manner in which they are solved. These—the subject of the present application—are puzzles solved by arranging scrambled visual information in a predetermined pattern. Included within this grouping (herein sometimes called "visual information rearrangement puzzles") are the venerable sliding tile puzzles (i.e., the image-beating variety) and jigsaw puzzles, as well as the more recent and mechanically fascinating three-dimensional multi-colored solid puzzles in the nature of the so-called "Rubik's Cube" and its progeny.

While conventional formats for visual information rearrangement puzzles remain popular, novel means have been sought for enhancing their challenge (i.e., their difficulty).

SUMMARY

The present inventor has found that rather than utilize static visual image information, the image provided on the pieces of such rearrangement puzzles can be designed holographically such that more than one form of visual image information is provided thereon, and such that the particular form of image information observed would be dependent on the viewer's (i.e., the puzzle player's) viewing angle. Accordingly, in one respect, the present invention provides a puzzle comprising a plurality of puzzle pieces arrangeable to form at least one surface according to a predetermined visually recognizable pattern, and wherein at least one of said pieces bears a reflection hologram designed to reconstruct a first form of visual image information when observed at a first viewing angle and a second form of visual image information when observed at a second viewing angle.

As an alternative means for increasing puzzle challenge, the present inventor has also found that for certain holographic visual information rearrangement puzzles (i.e., those where orientation of a puzzle piece provides clues useful for its solution), rather than multiplying and therefore confusing the visual clues—as is the case with a multi-image holographic puzzle piece—the visual clues thereon can be reduced. Accordingly, as another aspect of the present invention, there is provided a puzzle comprising a plurality of puzzle pieces arrangeable to form at least one surface according to a predetermined visually recognizable pattern, and wherein at least one of said pieces bears a reflection hologram designed to reconstruct visual image information, the peak angle of reconstruction being substantially normal to said surface.

As is already implicit, several embodiments are envisioned. However, in the presently preferred embodiment, the present invention is designed as a multi-image holographic sliding tile puzzle. The sliding tile puzzle comprises a frame and a plurality of tiles, each bearing a reflection display hologram. The tiles are slidably engaged within said frame such that the tiles can be sequentially rearranged from a disordered unsolved arrangement to a predetermined ordered arrangement. In accordance with the broader invention, at least one of said tiles bears a reflection hologram capable of reconstructing different holographic images when viewed at different viewing angles.

Regardless of its particular embodiment, it is a principal object of the present invention to provide a visual information rearrangement puzzle having an enhanced degree of challenge.

It is another object of the present invention to provide a puzzle solved by arranging scrambled visual image information in a predetermined pattern, wherein said visual image information changes at different viewing angles.

It is another object of the present invention to provide a sliding time puzzle comprising a frame and a plurality of tiles, wherein at least one of said tiles bears a reflection hologram capable of reconstructing different holographic images when viewed at different viewing angles.

It is another object of the present invention to provide a puzzle solved by arranging scrambled holographic image information in a predetermined pattern, at least one of the pieces of the puzzle having a holographic configuration that does not provide or significantly limits the angular reconstruction clues that would otherwise belie the correct orientation of the piece respective of the solved puzzle.

With these and other objects in view which will more readily appear as the nature of the invention is better understood, the invention subsists in its novel combination and assembly of parts hereinafter more fully described and claimed.

DETAILED DESCRIPTION OF THE INVENTIVE SUBJECT MATTER

Figure 1:
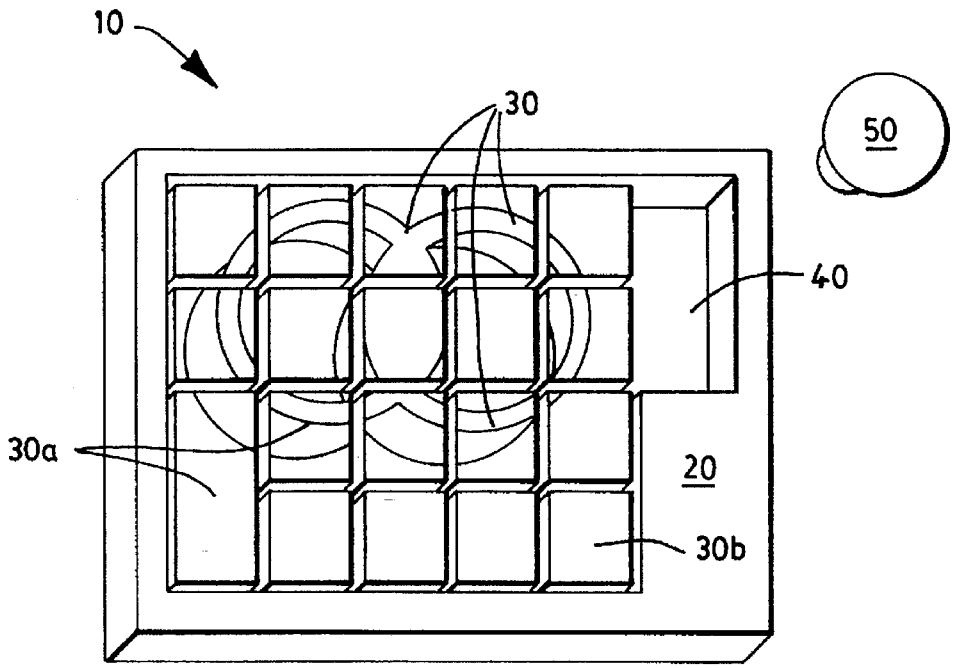
FIG. 1 schematically illustrates an embodiment (i.e., sliding tile puzzle 10) of the present invention viewed by a viewer 50 from a first viewing angle.

Defined broadly, the present invention provides a puzzle of the type solved by arranging scrambled visual information in a predetermined visually recognizable pattern, the puzzle comprising a plurality of puzzle pieces arrangeable to form at least one surface according to said predetermined visually recognizable pattern, and at least one (but preferably a majority) of said pieces bearing a reflection hologram designed to reconstruct a first form of visual information (e.g., a 2-dimensional image of the number 1 on the face of a cube, or a portion of an 3-dimensional image on a single jigsaw puzzle piece) when observed at a first viewing angle and a second form of visual information when observed at a second viewing angle (e.g., a 2-dimensional image of the letter "A" on the same face of the aforementioned cube, or a portion of a different 3-dimensional image on the same jigsaw puzzle piece).

While much latitude is available for the designing the first and second forms of visual information, the preferred embodiments of the present invention do not encompass the use of single-image display hologram on a visual information rearrangement puzzle. Rather, the aforementioned first and second forms of visual information must be "different in type" (e.g., a blooming flower at a first viewing angle and a wilted flower in the second viewing angle), not merely "different in perspective" (e.g., a chess piece observed at 0° at a first viewing angle 0° of normal and the same chess piece observed at 5° at a second viewing angle 5° of normal), or "different in color" (e.g., red at one angle and green at another).

Since the limitation that the first and second forms of visual information must be "different in type" is designed to enhance the challenge of the inventive puzzle, a puzzle piece should not have recorded therein several sequential forms of related visual information sequentially reconstructing at closely spaced adjacent viewing angles, such as in multiplex stereograms. Such configuration would serve only to blur the distinctiveness of the each form of visual information. Accordingly, in holograms having several forms of visual image information, a "second form of visual image information" is construed herein as being that which is reconstructed at the angle closest to the angle at which the "first" form is reconstructed.

In one embodiment, the puzzle is provided in the form of a standard jigsaw puzzle, wherein said plurality of puzzle pieces are interlocking jigsaw puzzle pieces. In another embodiment, said plurality of puzzle pieces form a geometric solid having a plurality of flat faces, each of said faces comprising a combination of the facing surfaces of a changeable grouping of said plurality of puzzle pieces (e.g., a "Rubik's Cube"-type puzzle). Other image reconstruction puzzle formats can be found in Jerry Slocum and Jack Botermans, *Puzzles: Old & New: How to Make and Solve Them*, (Europe bv: Plenary Publications International, 1986) (ISBN-0-295-96350-6)

Figure 2:
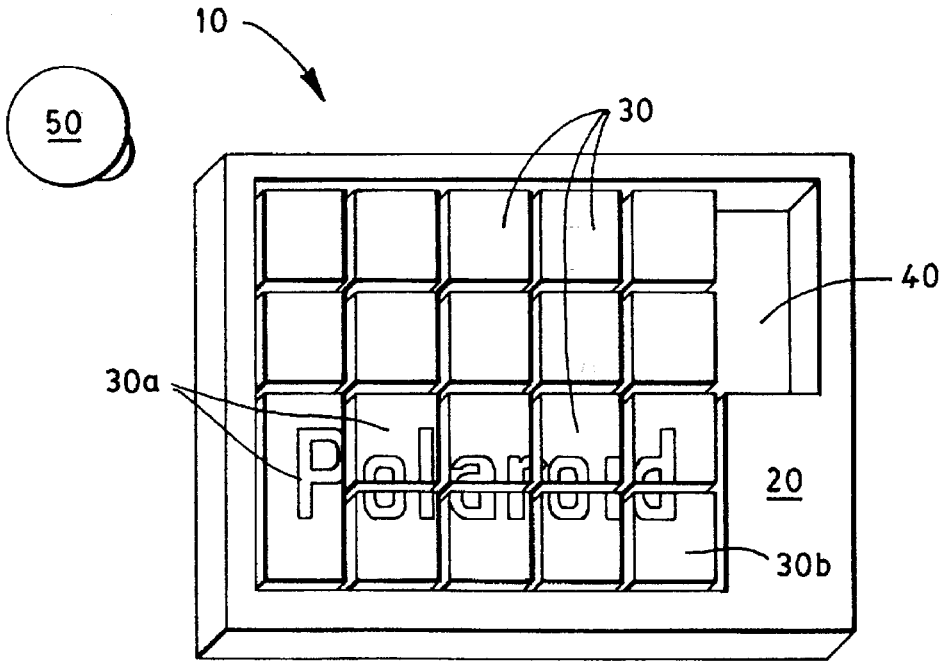
FIG. 2 schematically illustrates the same sliding tile puzzle 10 depicted in FIG. 1, but viewed by viewer 50 from a second viewing angle.

Regardless of the puzzle's format, the subject matter of the present invention can be fully appreciated by referring to the particular (and herein preferred) embodiment illustrated in FIGS. 1 and 2.

Referring to FIG. 1, a multi-image holographic sliding tile puzzle 10 is provided comprising a frame 20 and a plurality of tiles 30. Each of the tiles bears a reflection display hologram. The tiles 30 are slidably engaged within said frame 20 such that the tiles can be sequentially rearranged from a disordered unsolved arrangement to a predetermined ordered arrangement. FIG. 1 illustrates the sliding tile puzzle 10 in its predetermined ordered arrangement (i.e., solved). The disordered unsolved arrangement is accomplished by sequentially, randomly, and repeatedly moving tiles into an adjacent open spaces (see e.g., open space 40).

In accordance with the present invention, at least one of said tiles 30 bears a reflective display hologram capable of reconstructing more than one holographic image when viewed at different viewing angles. In this regard, tiles 30*a* of sliding tile puzzle 10 of FIGS. 1 and 2 produces two visual image forms at two different angles. Overall, in the viewing angle of FIG. 1, the viewer 50 perceives a 3-dimensional rendition of the crossed polarizer logo of POLAROID CORPORATION. In the viewing angle of FIG. 2, the viewer 50 perceives a 2-dimensional image of the trademark "POLAROID". Such configuration confuses the primary visual clues that a puzzle player (the viewer 50) would utilize in solving the puzzle. (It will be readily appreciated that this heightened challenge is especially pronounced in a jigsaw puzzle, since the orientation of the interlocking pieces used therein is not confined by a frame, or framework and therefore, not easily determined.)

From the sliding tile puzzle 10 shown in FIGS. 1 and 2, one will note that not all tiles contain more than one form of visual image information on each tile. For example, although clearly providing visual image information in FIG. 2, tile 30*b* does not provide viewer 50 with any useful visual image information at the viewing angle depicted in FIG. 1. While the present inventor envisions that multi-image holographic sliding tile puzzles can be made wherein each tile provides only one form of visual image information, such puzzles are not presently considered desirable. Accordingly, in respect of the invention, at least one tile, but preferably a majority, should be capable of holographically reconstructing a first and second form of visual image information.

As discussed in summary above, the present inventor has also found an alternate means for enhancing the challenge of certain holographic visual information rearrangement puzzles, particularly those puzzles where the orientation of a puzzle piece must be considered in working the puzzle, e.g., holographic jigsaw puzzles, holographic versions of so-called "heads and tails" puzzles, and other like holographic puzzles having loose pieces, the orientation of which are not restricted by a frame or framework.

Under conventional methodologies, the holograms provided on such puzzles would be configured as off-axis display holograms, such that when the piece is inspected by the puzzle player, the visual image information recorded therein is reconstructed at a particular angle, which—upon comparison with other pieces—provides clues as to the correct orientation of the inspected piece respective of the solved puzzle.

In contrast to conventional holographic rearrangement puzzles, the present invention provides a puzzle comprising a plurality of puzzle pieces arrangeable to form at least one surface according to a predetermined visually recognizable pattern, and wherein at least one of said pieces bears a reflection hologram designed to reconstruct visual image information, the peak angle of reconstruction being substantially normal to said surface. Configured in this manner, upon inspection of a puzzle piece, the puzzle player will perceive the visual image information recorded thereon at its brightest at 0° normal, regardless of the piece's orientation.

Many avenues exist for the provision of holograms on the pieces of the inventive puzzle. For multi-image holograms, the easiest would be to use commercially available, premade multi-image holograms, cut or trimmed to the shape of the puzzle piece. Premade reflective display holograms capable of holographically reconstructing first and second forms of visual image information are commercially available from POLAROID CORPORATION, and sold under the tradename PHANTAGRAMS. If original multi-image holograms are desired, one can follow any of the several known methodologies for making such holograms. For example, the techniques of holographic spatial multiplexing are well documented and are well-known to those skilled in the art of holography.

Under another methodology for example, preparation of the multi-image hologram commences with the deposition of a layer of a photoactivatable formulation onto a light transmissive web to form a holographic recording medium. Deposition of the formulation may be effected by spin coating, slot coating, curtain coating, and the like.

Light transmissive web comprises a transparent material so that irradiation used for exposure can be transmitted therethrough for imaging the holographic medium. The web can comprise any of a variety of sheet materials, although flexible polymeric sheet materials are preferred. Among preferred materials are polystyrene, polyethylene terephthalate, polyethylene, polypropylene, poly(vinyl chloride), polycarbonate, poly(vinylidene chloride), cellulose acetate, cellulose acetate butyrate, and copolymeric materials such as the copolymers of styrene, butadiene, and acrylonitrile, including poly(styrene-co-acrylonitrile). An especially preferred web material from the standpoints of durability, dimensional stability, and handling characteristics is polyethylene terephthalate.

Where it is desired to use a flexible web of low birefringence, e.g., surface hydrolyzed cellulose triacetate film base, such a coated film may be laminated to a glass plate with the photoactivatable coating outermost. Such a construction provides the benefits of continuous coating technology and rigidity during exposure, as well as avoiding exposure of the film base to solvents used in the various processing solutions, particularly where such solvents might adversely affect the flatness or dimensional stability of the film base.

The photoactivatable formulation may be made of any composition that is actinically-activatable by exposure to coherent irradiation, and whereby fringe structures are produced when the composition is deposited as a planar layer and appropriately exposed. Compositions that may be considered for use include DMP-128 (a proprietary photopolymer from Polaroid Corporation), dichromated gelatin, silver-halide based compositions, and compositions described in U.S. Pat. No. 4,588,664, issued to F. L. Fielding and R. T. Ingwall on May 13, 1986, and U.S. Pat. No. 4,696,876, issued to J. J. Cael on Sep. 29, 1987. As indicated above, DMP-128 is the preferred material and generally comprises a dye sensitizer, a branched polyethylenimine, and a free radical polymerizable ethylenically unsaturated monomer. Particular details of the composition may be found in U.S. Pat. No. 4,588,664. See also, W. C. Hay and B. D. Guenther, "Characterization of Polaroid's DMP-128 Holographic Recording Medium", Proceedings of the SPIE, 883, pp. 102–105 (1988).

The coating thickness of the photoactivatable composition is not particularly critical and may be selected according to the features and aspects desired in the resultant multi-image hologram. Illustratively, for example, the dry thickness of the layer of photopolymerizable composition based on DMP-128 will be about 2–10 microns, although coatings may be as thick as 25–30 microns for certain applications.

In a second step, the first form of visual image information (e.g., a three-dimensional object) is holographically recorded in an unexposed layer of the holographic medium. In this recordation step, an interference pattern is provided by the combination of an object beam and a reference beam substantially coherent therewith. During exposure, the object beam impinges upon planar hologram layer from a first side subsequent to its modulation, for example, by interruption with a desired predetermined three-dimensional object. At the same time, a reference beam impinges upon the planar hologram layer from a second side opposite the first side. The interaction of the beams produces a relatively stable interference pattern within the hologram layer. When the interference pattern is illuminated, the visual image information can be observed at the viewing angles correspondent with the hologram's reconstruction angle, the reconstruction angle being determined in part by the reference beam's angle of incidence during recordation. To effect recordation of another form of visual image information, the above process is repeated on the same medium, but with the reference beam set at a different angle of incidence.

To provide holograms for the embodiment of the present invention wherein at least one of its pieces bears a reflection hologram designed to reconstruct visual image information at a peak angle substantially normal to surface of the piece, one may simply set the angle of incidence of the reference beam at 0°, i.e., normal to the surface of the hologram layer.

The exposure time may be readily determined by routine testing, as is well known in the art, and will vary according to the intensity of the exposing radiation, the distance from the object to the photopolymerizable element, and like factors. These factors may be varied as necessary to change the exposure duration, either shorter or longer, as desired to obtain the preferred combination of exposure duration and light intensity for a given recordation. It will be appreciated that in the formation of a volume phase hologram on DMP-128, a subsequent non-imagewise or flood exposure to white light is useful to "fix" the photopolymerizable layer.

Under certain circumstances, the production of original volume phase reflective holograms may be inconsistent with desirable product process times. Accordingly, an original hologram may be utilized as a master for the mass production of several duplicate holograms. Several processes are known in the art for the mass production of reflection holograms. See e.g., U.S. Pat. No. 4,995,685; and "Copying Reflection Holograms," Journal of the Optical Society of America, vol. 58, pp. 856–857 (Jun. 1968). One skilled in that art, in view of the present disclosure, may readily incorporate such methodology into the present invention.

Subsequent to its exposure, the recording medium may then be processed to develop the recorded latent interference pattern and thereby produce a multi-image reflection hologram. In this regard, the recording medium may be developed to, for example, intensify the imaged element (such as by treatment with 2-isopropanol in the case of DMP-128), or to "fix" (or otherwise make more stable) photopolymeric reaction products (cf., fringe structures) actinically generated by the exposure. Certain details concerning the use and processing of photopolymerizable compositions used for holographic recordings can be found, for example, in aforementioned U.S. Pat. No. 4,588,664, issued to H. L. Fielding and R. T. Ingwall on May 13, 1986; aforementioned U.S. Pat. No. 4,696,876, issued to J. J. Cael on Sep. 27, 1987, and U.S. Pat. No. 5,198,912, issued to R. T. Ingwall, M. A. Troll, and D. H. Whitney on Mar. 30, 1993. Those skilled in the art will know of the various methods for processing the various types of recording media that may be used in the present invention.

It will be appreciated that subsequent processing will depend on the nature of the selected recording medium. Accordingly, construction of the term "development" will compel consideration of the processes desired and/or required to finalize, or otherwise prepare for use, a particular imaged recording medium.

In a third stage, an adhesive layer is provided onto the recorded planar hologram layer on the side opposite light transmissive web. Formulations for the preparation of adhesives are several and well known and may be applied to the web-borne planar hologram layer by a number of different methodologies. It can be coated, for example, directly onto the planar hologram layer out of organic or aqueous based solvent mixtures, or it can be applied, for example, by hot melt extrusion, lamination, or coating. In a desirable embodiment of the present invention, a preformed, double-sided, pressure-sensitive adhesive tape such as Kayapolar AD-20 (from Kayapolar Corp., Tokyo, Japan) is used.

Upon provision of the adhesive layer onto the web-borne planar hologram layer, the multi-image producing hologram can then be adhered onto a finished puzzle piece with the web facing outwards, and thus, beneficially protecting the hologram layer. Alternatively, the web-borne planar hologram layer may be adhered onto a precursor material (e.g., wood, tile, or plastic sheets) and then shaped, cut, united, tooled, and/or assembled into the finished puzzle piece(s).

In the above methodology, one can use an embossed reflective display hologram instead of the web-borne planar hologram layer. However, in light of the irregular surface topology of certain embossed display holograms—a topology that could provide unwanted visual clues—substitution in all cases is not entirely desirable.

In any event, an embossed reflective display hologram is typically formed from an off-axis master hologram in a multi-step process. The first step usually involves making the master off-axis hologram where the real object is positioned some distance from the surface of the recording medium and the reference beam is a collimated or parallel beam.

The second step usually involves illuminating the master off-axis hologram with a collimated beam of light to project a real image of the object into space. A second hologram is then made by positioning a new recording medium at the position of the projected real image and by introducing a new reference beam at an angle. As with volume phase holograms, the steps of recordation can be repeated in accordance with known methodologies to effect recordation of the second form of visual image information.

The third step of making an embossed hologram usually involves coating the surface of the holographic photoresist exposed in the second step with a conducting metal, such as silver, then immersing the coated hologram in an electroplating bath to plate a layer, such as a layer of nickel, thereon.

The fourth step involves using the nickel plate layer as a hard master to emboss the interference pattern into plastic that has been softened by heat, pressure, solvents, or some combination thereof in a continuous fashion.

Finally, in the last step, after embossing, the plastic is typically coated with a highly reflecting metal, like aluminum, to enhance the reconstruction efficiency of the embossed hologram.

While only a few illustrative embodiments of the present invention have been discussed, it is understood that various modification will be apparent to one skilled in the holographic art in view of the totality of the description herein. All such modifications are within the spirits and scope of the invention as encompassed by the appended claims.

I claim:

1. A puzzle solved by arranging scrambled visual information in a predetermined visually recognizable pattern, the puzzle comprising a plurality of puzzle pieces arrangeable to form at least one surface according to said predetermined visually recognizable pattern, at least one of said pieces bearing a reflection hologram designed to reconstruct a first form of visual image information when observed at a first viewing angle and a second form of visual image information when observed at a second viewing angle, said first and second forms of visual image information being different in type a the puzzle piece absent recordations of forms of visual image information sequentially reconstructable at viewing angles intermediate said first and second viewing angles.

2. The puzzle of claim 1, wherein said reflection hologram is a reflection display hologram, and wherein said first and second forms of visual image information are three-dimensional image information.

3. The puzzle of claim 1, wherein said reflection hologram is a reflection display hologram, and wherein said first and second forms of visual image information are two-dimensional image information.

4. The puzzle of claim 1, wherein said reflection hologram is a reflection display hologram, wherein said first form of visual image information is two-dimensional image information, and said second form of visual image information is three-dimensional image information.

5. The puzzle of claim 1, wherein a majority of said pieces bears a reflection hologram designed to reconstruct a first form of visual image information when observed at a first viewing angle and a second form of visual image information when observed at a second viewing angle.

6. The puzzle of claim 1, wherein said puzzle is a sliding tile puzzle comprising a frame and a plurality of tiles, said plurality of tiles being said plurality of puzzle pieces, and said tiles being slidably engaged within said frame such that the tiles can be sequentially rearranged from a disordered unsolved arrangement to a predetermined ordered arrangement.

* * * * *